US011602163B2

(12) United States Patent
Gonzalez Florez et al.

(10) Patent No.: US 11,602,163 B2
(45) Date of Patent: Mar. 14, 2023

(54) SHISHA DEVICE WITH AEROSOL CONDENSATION

(71) Applicant: PHILIP MORRIS PRODUCTS S.A., Neuchâtel (CH)

(72) Inventors: Ana Isabel Gonzalez Florez, Neuchâtel (CH); Jakub Bialek, Neuchâtel (CH); Leander Dittmann, Neuchâtel (CH)

(73) Assignee: Philip Morris Products S.A., Neuchatel (CH)

( * ) Notice: Subject to any disclaimer, the term of this patent is extended or adjusted under 35 U.S.C. 154(b) by 243 days.

(21) Appl. No.: 16/753,467

(22) PCT Filed: Sep. 17, 2018

(86) PCT No.: PCT/IB2018/057112
§ 371 (c)(1),
(2) Date: Apr. 3, 2020

(87) PCT Pub. No.: WO2019/069160
PCT Pub. Date: Apr. 11, 2019

(65) Prior Publication Data

US 2020/0329760 A1 Oct. 22, 2020

(30) Foreign Application Priority Data

Oct. 6, 2017 (EP) ..... 17195274

(51) Int. Cl.
*A24F 13/00* (2006.01)
*A24F 17/00* (2006.01)
(Continued)

(52) U.S. Cl.
CPC ..... *A24F 1/30* (2013.01); *A24B 15/167* (2016.11); *A24F 40/10* (2020.01); *A24F 40/42* (2020.01)

(58) Field of Classification Search
CPC ..... A24B 15/167; A24F 1/30; A24F 40/10; A24F 40/42
See application file for complete search history.

(56) References Cited

U.S. PATENT DOCUMENTS 4,648,410 A * 3/1987 Seroussi ..... A24F 1/30 131/173
9,095,174 B2 8/2015 Capuano
(Continued)

FOREIGN PATENT DOCUMENTS

CH 698789 B1 10/2009
CN 103271447 A 9/2013
(Continued)

OTHER PUBLICATIONS

Russian Office Action for RU 2020115138 issued by the Patent Office of the Russian Federation dated Dec. 27, 2021; 14 pgs. including English Translation.
(Continued)

*Primary Examiner* — Abdullah A Riyami
*Assistant Examiner* — Thang H Nguyen
(74) *Attorney, Agent, or Firm* — Mueting Raasch Group

(57) ABSTRACT

A method includes generating an aerosol by heating, without combusting, an aerosol generating substrate (300) in a shisha device (100). The method further includes introducing at least one aerosol condensation particle to an airflow path (103) of the shisha device. The airflow path (103) carries the aerosol generated by the aerosol generating substrate to an outlet (104) of the shisha device for delivery to a user.

19 Claims, 5 Drawing Sheets

(51) Int. Cl.

| | |
|---|---|
| ***A24F 25/00*** | (2006.01) |
| ***A24F 1/30*** | (2006.01) |
| ***A24B 15/167*** | (2020.01) |
| ***A24F 40/10*** | (2020.01) |
| ***A24F 40/42*** | (2020.01) |

(56) References Cited

U.S. PATENT DOCUMENTS

| | | | | |
|---|---|---|---|---|
| 9,888,714 | B2 | 2/2018 | Cameron et al. | |
| 10,244,795 | B2 * | 4/2019 | Batista | A24F 40/48 |
| 11,089,813 | B2 * | 8/2021 | Borkovec | H05B 3/46 |
| 11,197,966 | B2 * | 12/2021 | Yener | A61M 11/042 |
| 2010/0126516 | A1 * | 5/2010 | Yomtov | A24F 1/30 29/401.1 |
| 2012/0006342 | A1 | 1/2012 | Rose et al. | |
| 2013/0032159 | A1 * | 2/2013 | Capuano | A24F 1/30 131/329 |
| 2015/0027456 | A1 | 1/2015 | Janardhan et al. | |
| 2016/0066619 | A1 * | 3/2016 | Di Carlo | A24F 40/50 131/329 |
| 2016/0135506 | A1 | 5/2016 | Sanchez et al. | |
| 2016/0324212 | A1 | 11/2016 | Cameron | |
| 2017/0099873 | A1 * | 4/2017 | Benjamignan | H01M 10/486 |
| 2017/0251718 | A1 * | 9/2017 | Armoush | A24F 1/30 |
| 2017/0265521 | A1 * | 9/2017 | Do | A24F 1/30 |
| 2017/0280775 | A1 * | 10/2017 | Manca | A24F 40/48 |
| 2018/0256560 | A1 | 9/2018 | Hoppe et al. | |
| 2019/0110519 | A1 | 4/2019 | Meyer et al. | |
| 2020/0022408 | A1 * | 1/2020 | Kolyris | A24F 40/50 |

FOREIGN PATENT DOCUMENTS

| | | | | |
|---|---|---|---|---|
| CN | 104770875 | A | 7/2015 | |
| CN | 104770876 | A | 7/2015 | |
| CN | 104770878 | A | 7/2015 | |
| CN | 106072762 | A | 11/2016 | |
| CN | 108882748 | A | 11/2018 | |
| EP | 3275319 | A1 | 1/2018 | |
| RU | 142147 | U1 | 6/2014 | |
| WO | WO 2014/102092 | A1 | 7/2014 | |
| WO | WO-2015112750 | A1 * | 7/2015 | A24F 40/46 |
| WO | WO 2015/177255 | A1 | 11/2015 | |
| WO | WO 2017/178931 | A1 | 10/2017 | |

OTHER PUBLICATIONS

European Search Report issued by the European Patent Office dated Mar. 27, 2018; 5 pgs.

International Search Report and Written Opinion issued by the European Patent office dated Nov. 23, 2018; 9 pgs.

International Preliminary Report on Patentability for PCT/IB2018/057112 issued by the International Bureau of WIPO; dated Apr. 16, 2020; 7 pgs.

Chinese Office Action issued by the China National Intellectual Property Administration for CN Application 201880059452.3, dated Dec. 19, 2022; 25 pgs. including English translation.

* cited by examiner

SHISHA DEVICE WITH AEROSOL CONDENSATION

This application is the § 371 U.S. National Stage of International Application No. PCT/IB2018/057112, filed 17 Sep. 2018, which claims the benefit of European Application No. 17195274.0, filed 6 Oct. 2017.

INTRODUCTION

The present disclosure relates to shisha devices; more particularly, to shisha devices that heat an aerosol generating substrate without combusting the substrate and that enhance characteristics of generated aerosol.

Shisha devices are typically used to smoke tobacco and are configured such that vapor and smoke pass through a water basin before inhalation by a consumer. Shisha devices may include one outlet or more than one outlet so that the device can be used by more than one consumer at a time. Use of shisha devices is considered by many to be a leisure activity and a social experience.

The tobacco used in shisha devices may be mixed with other ingredients to, for example, increase the volume of the vapor and smoke produced, to alter flavour, or both. Charcoal pellets are typically used to heat the tobacco in a shisha device, which may cause full or partial combustion of the tobacco or other ingredients.

Some shisha devices have been proposed that use electrical heat sources to heat or combust the tobacco to, for example, avoid by-products of burning charcoal or to improve the consistency with which the tobacco is heated or combusted. However, substituting an electric heater for charcoal may result in unsatisfactory production of aerosol in terms of visible smoke or aerosol, total aerosol mass, or visible smoke or aerosol and aerosol mass.

It is desirable to provide a shisha device that employs an electric heater that produces a satisfactory amount of one or both of visible aerosol and total aerosol mass.

It is also desirable to provide a shisha device that heats a substrate in a manner that does not result in combustion by-products.

SUMMARY

In various aspects of the present invention there is provided a method comprising generating an aerosol by heating, without combusting, an aerosol generating substrate in a shisha device; and introducing at least one aerosol condensation particle to an airflow path of the shisha device. The airflow path carries the aerosol generated by the aerosol generating substrate to an outlet of the shisha device for delivery to a user. The method may result in increased visible aerosol or increased total aerosol mass.

In various aspects of the present invention there is provided a shisha device configured to carry out the method. The shisha device may comprise a vessel, an aerosol generating element, and an aerosol condensation particle dispenser. The vessel defines an interior configured to contain a volume of liquid. The vessel comprises a headspace in communication with the outlet for delivering the aerosol to the user. The aerosol generating element is in fluid connection with the vessel and is configured to heat the aerosol generating substrate. The aerosol condensation particle dispenser is configured to deliver at least one aerosol condensation particle to the airflow path.

Various aspects or embodiments of the shisha devices described herein may provide one or more advantages relative to existing shisha devices. For example, one or more shisha devices described herein may produce substantially more visible aerosol, deliver substantially more total aerosol mass, or produce substantially more visible aerosol and deliver substantially more total aerosol mass than similar devices in which an aerosol condensation particle is not delivered to the airflow path. Accordingly, a user of the device may have an experience more typical of a shisha device in which an aerosol generating substrate is combusted with charcoal, but without combustion by-products of the charcoal or the aerosol generating substrate. These and other advantages of the shisha devices described herein will be evident to those of skill in the art upon review of the present disclosure.

The methods, devices, and systems described herein may provide for increased visible aerosol, increased delivery of total aerosol mass, or increased visible aerosol and increased delivery of total aerosol mass in shisha devices comprising aerosol generating elements having electric heaters that heat but do not combust an aerosol generating substrate. The increase in one or both of visible aerosol and total aerosol mass results from introducing the aerosol condensation particle into an airflow path configured to carry aerosol generated by heating the aerosol generating substrate to an outlet for delivery to a user by inhalation. Without intending to be bound by theory, it is believed that the aerosol condensation particle promotes a process of heterogeneous nucleation, which increases one or both of visible aerosol and total aerosol mass.

DETAILED DESCRIPTION

As used herein, the term "aerosol condensation particle" refers to any particulate matter that may act as a seed or a nucleation site on or about which vapor particles may condense to form solid particles or liquid droplets in the form of an aerosol. The aerosol condensation particle may be a solid particle or may be a liquid droplet.

The methods, devices and systems described herein may introduce one aerosol condensation particle to the airflow path. However, typically the methods, devices and systems described herein introduce a plurality of aerosol condensation particles into the airflow path.

It may be advantageous to provide the at least one aerosol condensation particle in the airflow path at the location at which the vapor concentration is at its greatest. Where a plurality of aerosol condensation particles are introduced to the airflow path, it may be advantageous to introduce the plurality of aerosol condensation particles to the airflow path as close as possible to the substrate, such that the concentration of aerosol condensation particles in the airflow path is at its greatest at the location in the airflow path at which the concentration of the vapor is at its greatest. Typically, the concentration of vapor in the airflow path is at its greatest at or around the aerosol generating substrate. Accordingly, it may be advantageous to introduce the at least one aerosol condensation particle to the airflow path as close as possible to the aerosol generating substrate. This may further promote nucleation and increase one or both of visible aerosol and total aerosol mass.

The at least one aerosol condensation particle may be introduced to the airflow path at any suitable location in the airflow path relative to the aerosol generating substrate. The at least one aerosol condensation particle may be introduced to the airflow path upstream of the substrate, at the substrate, or downstream of the substrate, provided that the at least one aerosol condensation particle ultimately is present in the vapor generated by the substrate.

Where the at least one aerosol condensation particle is introduced to the airflow path downstream of the substrate, the at least one aerosol condensation particle may be introduced to the airflow path within 20 centimetres of the substrate, within 5 centimetres of the substrate or within 2 centimetres of the substrate.

As used herein, "upstream" and "downstream" are relative to an airflow path through a shisha device. The downstream end of the airflow path is the end at which aerosol is delivered to a user of the device.

Any suitable aerosol condensation particle may be introduced to the airflow path configured to carry the aerosol to the outlet for delivery to the user. Particles having a size in a range from about 0.01 micrometres to about 5 micrometres may be suitable for promoting heterogeneous nucleation, and thus may generate one or both of increased visible aerosol and total aerosol mass. The aerosol condensation particles may have an average size of between about 0.01 micrometres to about 5 micrometres, between about 0.05 micrometres to about 2 micrometre, between about 0.1 micrometres to about 0.3 micrometres or about 0.2 micrometres.

The at least one aerosol condensation particle may comprise, for example, sodium chloride (NaCl), potassium chloride (KCl), a carbon particle, or any other suitable particulate matter.

The at least one aerosol condensation particle may be formed from a liquid composition, such as a solution, dispersion or suspension. For example, the at least one aerosol condensation particle may comprise a droplet of the liquid composition. The liquid composition may comprise water and one or more additional components to enhance aerosol condensation. For example, the liquid composition may comprise sodium chloride (NaCl), potassium chloride (KCl), a carbon particle, or any other suitable component. The liquid composition may comprise water and sodium chloride. The sodium chloride may be present any suitable concentration in the atomized solution. For example, the liquid composition may comprise sodium chloride in a concentration from about 5 grams of NaCl in 1 litre of distilled water to about 50 grams of NaCl in 1 litre of water, from about 20 grams of NaCl in 1 litre of distilled water to about 50 grams of NaCl in 1 litre of distilled water or about 35 grams of NaCl in 1 litre of distilled water. The salt concentration in atomized solution influences the size of atomized dry aerosol.

Where the at least one aerosol condensation particle is formed from a liquid composition, such as water and one or more additional components to enhance aerosol condensation, the at least one aerosol condensation particle may be introduced to the airflow path upstream of the substrate and particularly upstream of the heater. In some embodiments, this may be advantageous as the water component of the aerosol condensation particle may not be necessary to promote nucleation of aerosol and the water content of the aerosol condensation particles may be substantially evaporated as the aerosol condensation particles in the airflow path are drawn past the heater. However, since the air in the airflow path is drawn over or through the aerosol generating substrate, some of the aerosol condensation particles introduced to the airflow path upstream of the substrate may be lost in collisions with the substrate. This may lead to a reduction in the number of aerosol condensation particles available to promote aerosol nucleation. Accordingly, in some embodiments it may be advantageous to introduce the at least one aerosol condensation particle to the airflow path downstream of the substrate. Where the at least one aerosol condensation particle is introduced to the airflow path downstream of the substrate, it may be advantageous to introduce the at least one aerosol condensation particle to the airflow path as close as possible to the substrate.

The at least one aerosol condensation particle may be introduced into the airflow path of the shisha device in any suitable manner. The at least one aerosol condensation particle may be introduced by an aerosol condensation particle dispenser. The at least one aerosol condensation particle may be introduced directly into the airflow path of the shisha device by the aerosol condensation particle dispenser. The at least one aerosol condensation particle may be introduced into the vicinity of the airflow path, at or around the airflow path by the aerosol condensation particle dispenser and may subsequently enter the airflow path.

The aerosol condensation particle dispenser may be any type of dispenser suitable for introducing aerosol condensation particles to the airflow path. For example, the aerosol condensation particle dispenser may be a nebulizer. Where the aerosol condensation particle dispenser is a nebulizer, the particle may be introduced in a nebulized form. Thus, aerosol condensation particle may comprise a nebulized droplet. A nebulized droplet may be produced in any suitable manner, such as breaking up a liquid composition into droplets using a compressed gas, such as compressed air, or an ultrasonic source. The formed droplets may be passed through a nozzle, such as a Venturi nozzle, for introduction into the airflow path. The size of the droplets may be controlled by, for example, the velocity of the gas and the characteristics of the nozzle.

In embodiments comprising a nebulizer, any suitable nebulizer may be employed to form aerosol condensation particles comprising droplets. For example, the nebulizer may comprise a source of compressed gas, such as compressed air, or ultrasonic vibration element to break up the liquid composition into droplets. The nebulizer may comprise nozzle positioned to direct the droplets to the airflow path of the shisha device. If the nebulizer employs a compressed gas, the gas may be present in a replaceable cartridge. The liquid composition to be nebulized may be contained in a replaceable container or may be in a refillable reservoir.

A shisha device of the present invention may comprise any suitable aerosol generating element, aerosol generating element, aerosol generating apparatus or aerosol generating element. For example, the shisha device may have a heater for heating an aerosol generating substrate to produce an aerosol. The aerosol generating substrate may be heated by an electric heater.

The shisha device may comprise a receptacle for receiving the aerosol generating substrate. The receptacle may be configured to receive a cartridge containing the aerosol generating substrate. The aerosol generating element may comprise the receptacle. The aerosol generating substrate may be contained in a cartridge. Where the aerosol generating substrate is contained in a cartridge, the receptacle may be configured to receive the cartridge. The aerosol generating substrate may be contained in the cartridge when heated by the heating element.

In embodiments in which the aerosol generating substrate is contained in a cartridge, the aerosol generating element may comprise a cartridge receptacle configured to receive the cartridge. The receptacle may be configured to receive one or both of a cartridge containing aerosol generating substrate and aerosol generating substrate directly. The aerosol generating element comprises a fresh air inlet and an aerosol outlet. When a user draws on the shisha device, fresh air may enter the fresh air inlet, pass over the surface of or through the aerosol generating substrate, and exit the aerosol outlet.

The heater of the aerosol generating element may define at least one surface of the receptacle for holding the aerosol generating substrate or cartridge. The heater may define at least two surfaces of the receptacle. For example, the heater may form at least a portion of two or more of a top surface, a side surface, and a bottom surface. The heater may define at least a portion of the top surface and at least a portion of a side surface. The heater may form the entire top surface and an entire side wall surface of the receptacle. The heater may be disposed on an inner surface or an outer surface of the receptacle.

Any suitable heater may be employed. In particular, the shisha device may comprise an electric heater. The electric heater may comprise one or both of resistive and inductive heating components. The electric heater may comprise any suitable resistive heating component. For example, the electric heater may comprise one or more resistive wires or other resistive elements. The resistive wires may be in contact with a thermally conductive material to distribute heat produced over a broader area. Examples of suitable conductive materials include aluminium, copper, zinc, nickel, silver, and combinations thereof. For purposes of this disclosure, if resistive wires are in contact with a thermally conductive material, both the resistive wires and the thermally conductive material are part of the heating element that forms at least a portion of the surface of the cartridge receptacle.

The electric heater may comprise any suitable inductive heating component. For example, the electric heater may comprise a susceptor material that forms a surface of the cartridge receptacle. As used herein, the term 'susceptor' refers to a material that is capable to convert electromagnetic energy into heat. When located in an alternating electromagnetic field, typically eddy currents are induced and hysteresis losses may occur in the susceptor causing heating of the susceptor. As the susceptor is located in thermal contact or close thermal proximity with the aerosol generating substrate, the substrate is heated by the susceptor such that an aerosol is formed. The susceptor may be arranged at least partially in direct physical contact with the aerosol generating substrate.

The susceptor may be formed from any material that can be inductively heated to a temperature sufficient to generate an aerosol from the aerosol generating substrate. The susceptor may comprise a metal or carbon. The susceptor may comprise or consist of a ferromagnetic or ferrimagnetic material, for example ferritic iron, a ferromagnetic or ferrimagnetic alloy, such as ferromagnetic steel or stainless steel, and ferrite. A suitable susceptor may be, or comprise, aluminium.

The susceptor may be a metal susceptor, for example stainless steel. However, susceptor materials may also comprise or be made of graphite, molybdenum, silicon carbide, aluminum, niobium, Inconel alloys (austenite nickel-chromium-based superalloys), metallized films, ceramics such as for example zirconia, transition metals such as for example Fe, Co, Ni, or metalloids components such as for example B, C, Si, P, Al.

A susceptor may comprise any suitable proportion of ferromagnetic or paramagnetic materials. For example, a susceptor may comprises at least 5%, at least 20%, at least 50% or at least 90% of ferromagnetic or paramagnetic materials. The susceptor may be heated to a temperature in excess of 250 degrees Celsius. Suitable susceptors may comprise a non-metallic core with a metal layer disposed on the non-metallic core, for example metallic tracks formed on a surface of a ceramic core.

The shisha device may also comprise one or more induction coil configured to induce eddy currents and/or hysteresis losses in a susceptor material, which results in heating of the susceptor material. A susceptor material may also be positioned in the cartridge containing the aerosol generating substrate. A susceptor element comprising the susceptor material may comprise any suitable material, such as those described in, for example, PCT Published Patent Applications WO 2014/102092 and WO 2015/177255.

The shisha device may comprise control electronics operably coupled to the resistive heating element or induction coil. The control electronics are configured to control heating of the heating element.

The control electronics may be provided in any suitable form and may, for example, include a controller or a memory and a controller. The controller may include one or more of an Application Specific Integrated Circuit (ASIC) state machine, a digital or analog signal processor, a gate array, a microprocessor, or equivalent discrete or integrated logic circuitry. Control electronics may include memory that contains instructions that cause one or more components of the circuitry to carry out a function or aspect of the control electronics. Functions attributable to control electronics in this disclosure may be embodied as one or more of software, firmware, and hardware.

The electronic circuitry may comprise a microprocessor, which may be a programmable microprocessor. The electronic circuitry may be configured to regulate a supply of power. The power may be supplied to the heater element or induction coil in the form of pulses of electrical current.

If the electric heater comprises a resistive heating element, the control electronics may be configured to monitor the electrical resistance of the resistive heating element and to control the supply of power to the resistive heating element depending on the electrical resistance of the resistive heating element. In this manner, the control electronics may regulate the temperature of the resistive heating element.

If the electric heater comprises an induction coil and the heating element comprises a susceptor material, the control electronics may be configured to monitor aspect of the induction coil and to control the supply of power to the induction coil depending on the aspects of the coil such as described in, for example, WO 2015/177255. In this manner, the control electronics may regulate the temperature of the susceptor material.

The shisha device may comprise at least one temperature sensor, such as a thermocouple, operably coupled to the control electronics to control the temperature of the heating elements. The at least one temperature sensor may be positioned in any suitable location. For example, the temperature sensor may be configured to insert into the aerosol generating substrate or a cartridge received within the receptacle to monitor the temperature of the aerosol generating substrate being heated. A temperature sensor may be in contact with a heating element of the heater. A temperature sensor may be positioned to detect temperature at an aerosol outlet of the shisha device, such as the aerosol outlet of the aerosol generating element. Each sensor may transmit signals regarding the sensed temperature to the control electronics, which may adjust heating of the heating elements to achieve a suitable temperature at the sensor.

Regardless of whether the shisha device includes a temperature sensor, the device may be configured to heat an aerosol generating substrate received in the receptacle to an extent sufficient to generate an aerosol without combusting the aerosol generating substrate.

The control electronics may be operably coupled to a power supply. The shisha device may comprise any suitable power supply. For example, a power supply of a shisha device may comprise at least one of a battery, a capacitor and a fuel cell. The power supply may comprise a battery. In some examples, the power supply may comprise a battery configured such that the geometry, size and form factor of the battery conform to a portion of the shisha device. For example, the cathode and anode elements of the battery may be rolled and assembled to match the geometries of a portion of a shisha device in which they are disposed. The power supply may be rechargeable. The power supply may be removable and replaceable. Any suitable power supply may be used. For example, heavy duty type or standard batteries existing in the market, such as those used for industrial heavy duty electrical power-tools. The power supply unit can be any type of electric power supply including a super or hyper-capacitor. In some embodiment, the device can be powered via a connection to an external electrical power source. The shisha device may be electrically and electronically designed for operation with its particular power supply. Regardless of the type of power supply employed, the power supply may provide sufficient energy for the normal functioning of the device for approximately 70 minutes of continuous operation of the device, before being recharged or needing to connect to an external electrical power source.

The shisha device comprises a fresh air inlet channel in fluid connection with the receptacle for containing the aerosol generating substrate. Fresh air may flow through the channel to the receptacle and the substrate disposed in the receptacle to carry aerosol generated from the aerosol generating substrate to the aerosol outlet when the shisha device is in use. At least a portion of the channel may be formed by a heating element to preheat the air prior to entering the receptacle.

The aerosol generating substrate may be heated, through one or both of the preheated air and heating from the heating elements, to a temperature in a range from about 150° C. to about 250° C.; from about 180° C. to about 230° C. or from about 200° C. to about 230° C. Such temperatures may be sufficient to produce an aerosol from the substrate without combusting the substrate.

The fresh air inlet channel may comprise one or more apertures through the receptacle such that fresh air from outside the shisha device may flow through the channel and into the receptacle through the apertures. If a channel comprises more than one aperture, the channel may comprise a manifold to direct air flowing through the channel to each aperture. The shisha device may comprise two or more fresh air inlet channels.

The receptacle may comprise any suitable number of apertures in communication with one or more fresh air inlet channels. For example, the receptacle may comprise 1 to 1000 apertures, such as 10 to 500 apertures. The apertures may be of uniform size or non-uniform size. The apertures may be uniformly distributed or non-uniformly distributed. The apertures may be formed in the cartridge receptacle at any suitable location. For example, the apertures may be formed in one or both of a top or a sidewall of the receptacle. The apertures may be formed in the top of the receptacle.

The receptacle may be shaped and sized to allow contact between one or more wall or ceiling of the receptacle and the aerosol generating substrate or a cartridge containing the aerosol generating substrate when the substrate or cartridge is received by the receptacle to facilitate conductive heating of the aerosol generating substrate by the heating element forming a surface of the receptacle. In some examples, an air gap may be formed between at least a portion of a cartridge containing the aerosol generating substrate and a surface of the receptacle.

The receptacle may be formed from one or more parts. The receptacle may be formed by two or more parts. At least one part of the receptacle may be movable relative to another part to allow access to the interior of the receptacle for inserting the cartridge into the receptacle. For example, one part may be removably attachable to another part to allow insertion of the aerosol generating substrate or the cartridge containing the aerosol generating substrate when the parts are separated. The parts may be attachable in any suitable manner, such as through threaded engagement, interference fit, snap fit, or the like. In some examples, the parts are attached to one another via a hinge. When the parts are attached via a hinge, the parts may also include a locking mechanism to secure the parts relative to one another when the receptacle is in a closed position. In some examples, the receptacle comprises a drawer that may be slid open to allow the aerosol generating substrate or cartridge to be placed into the drawer and may be slid closed to allow the shisha device to be used.

Any suitable aerosol generating cartridge may be used with a shisha device as described herein. The cartridge may comprise a thermally conductive housing. For example, the housing may be formed from aluminium, copper, zinc, nickel, silver, and combinations thereof. The housing may be formed from aluminium. In some examples, the cartridge is formed from one or more material less thermally conductive than aluminium. For example, the housing may be formed from any suitable thermally stable polymeric material. If the material is sufficiently thin sufficient heat may be transferred through the housing despite the housing being formed from material that is not particularly thermally conductive.

The cartridge may comprise one or more apertures formed in the top and bottom of the housing to allow air flow through the cartridge when in use. In some embodiments in which the top of the receptacle comprises one or more apertures, at least some of the apertures in the top of the cartridge may be aligned with the apertures in the top of the receptacle. In some embodiments in which the top of the receptacle comprises one or more apertures, at least some of the apertures in the top of the cartridge may be offset or not aligned with the apertures in the top of the receptacle. The cartridge may comprise an alignment feature configured to mate with a complementary alignment feature of the receptacle to locate the apertures of the cartridge relative to the apertures of the receptacle. For example, the cartridge may comprise an alignment feature configured to align the apertures of the cartridge with the apertures of the receptacle when the cartridge is inserted into the receptacle. The apertures in the housing of the cartridge may be covered during storage to prevent aerosol generating substrate stored in the cartridge from spilling out of the cartridge. In some embodiment, the apertures in the housing may have dimensions sufficiently small to prevent or inhibit the aerosol generating substrate from exiting the cartridge. If the apertures are covered, a consumer may remove the cover prior to inserting the cartridge into the receptacle. In some examples, the receptacle is configured to puncture the cartridge to form apertures in the cartridge. The receptacle may be configured to puncture the top of the cartridge.

Any suitable aerosol generating substrate may be placed in a cartridge for use with shisha devices of the invention or may be placed in the receptacle of the aerosol generating unit. The aerosol generating substrate may be a substrate capable of releasing volatile compounds that may form an aerosol. The volatile compounds may be released by heating the aerosol generating substrate. The aerosol generating substrate may be solid or liquid or comprise both solid and liquid components. The aerosol generating substrate may be solid.

The aerosol generating substrate may comprise nicotine. The nicotine containing aerosol generating substrate may comprise a nicotine salt matrix. The aerosol generating substrate may comprise plant-based material. The aerosol generating substrate may comprise tobacco. The tobacco containing material may contain volatile tobacco flavor compounds, which are released from the aerosol generating substrate upon heating.

The aerosol generating substrate may comprise homogenized tobacco material. Homogenized tobacco material may be formed by agglomerating particulate tobacco. Where present, the homogenized tobacco material may have an aerosol-former content of equal to or greater than 5% on a dry weight basis, and preferably between greater than 30% by weight on a dry weight basis. The aerosol-former content may be less than about 95% on a dry weight basis.

The aerosol generating substrate may comprise a non-tobacco-containing material. The aerosol generating substrate may comprise homogenized plant-based material.

The aerosol generating substrate may comprise, for example, one or more of: powder, granules, pellets, shreds, spaghettis, strips or sheets containing one or more of: herb leaf, tobacco leaf, fragments of tobacco ribs, reconstituted tobacco, homogenized tobacco, extruded tobacco and expanded tobacco.

The aerosol generating substrate may comprise at least one aerosol-former. The aerosol-former may be any suitable known compound or mixture of compounds that, in use, facilitates formation of a dense and stable aerosol and that is substantially resistant to thermal degradation at the operating temperature of the aerosol generating element. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine. The aerosol generating substrate may comprise other additives and ingredients, such as flavorants. The aerosol generating substrate may comprise nicotine and at least one aerosol-former. In a particularly preferred embodiment, the aerosol-former is glycerine.

The solid aerosol generating substrate may be provided on or embedded in a thermally stable carrier. The carrier may comprise a thin layer on which the solid substrate deposited on a first major surface, on second major outer surface, or on both the first and second major surfaces. The carrier may be formed of, for example, a paper, or paper like material, a non-woven carbon fiber mat, a low mass open mesh metallic screen, or a perforated metallic foil or any other thermally stable polymer matrix. The carrier may take the form of powder, granules, pellets, shreds, spaghettis, strips or sheets. The carrier may be a non-woven fabric or fiber bundle into which tobacco components have been incorporated. The non-woven fabric or fiber bundle may comprise, for example, carbon fibers, natural cellulose fibers, or cellulose derivative fibers.

In some examples, the aerosol generating substrate is in the form of a suspension. For example, the aerosol generating substrate may be in the form of a thick, molasses-like, suspension.

Air that enters the cartridge flows across the aerosol generating substrate, entrains aerosol, and exits the cartridge and receptacle via an aerosol outlet. From the aerosol outlet, the air carrying the aerosol enters a vessel.

The shisha device may comprise any suitable vessel defining an interior volume configured to contain a liquid and defining a headspace outlet. The headspace outlet is generally arranged at a headspace region of the vessel. The headspace region is typically above a liquid fill level of the vessel. The vessel may comprise an optically transparent or opaque housing to allow a consumer to observe contents contained in the vessel. The vessel may comprise a liquid fill demarcation, such as a liquid fill line. The vessel housing may be formed of any suitable material. For example, the vessel housing may comprise glass or suitable rigid plastic material. The vessel may be removable from a portion of the shisha device comprising the aerosol generation element to allow a consumer to fill or clean the vessel.

The vessel may be filled to a liquid fill level by a consumer. The liquid may comprise water, which may optionally be infused with one or more colorants, flavorants, or colorant and flavorants. For example, the water may be infused with one or both of botanical or herbal infusions.

Aerosol entrained in air exiting the aerosol outlet of the aerosol generating unit may travel through a conduit positioned in the vessel. The conduit may be coupled to the aerosol outlet and may have an opening below the liquid fill level of the vessel, such that aerosol flowing through the vessel flows through the opening of the conduit, then through the liquid, into headspace of the vessel and exits the headspace outlet for delivery to a consumer.

The headspace outlet may be coupled to a hose comprising a mouthpiece for delivering the aerosol to a consumer.

The shisha device may comprise a switch activatable by a user operably coupled to the control electronics of the shisha device. The switch may be arranged at any suitable position on the shisha device. For example, the switch may be arranged at the aerosol generating element, at the vessel or at the mouthpiece. The switch may be wirelessly coupled to the control electronics. Activation of a switch may cause the control electronics to activate the heating element, rather than constantly supplying energy to the heating element. Accordingly, the use of a switch may serve to save energy relative to devices not employing such elements to provide on-demand heating rather than constant heating.

The shisha device may comprise a puff sensor in communication with the airflow path. The puff sensor may be positioned at any suitable location of the airflow path. For example, the mouthpiece may comprise the puff sensor. The puff sensor may be operably coupled to the nebulizer to cause the nebulizer to deliver the at least one aerosol condensation particle to the airflow path in response to detection of a puff. The puff sensor may be operably coupled to the control electronics which may be coupled to the nebulizer.

The shisha device may comprise a chamber downstream of the aerosol generating element, having an inlet for accelerating incoming air, vapor and aerosol from the aerosol generating element. The chamber may be sized and shaped to enable deceleration of the air, vapor and aerosol as it exits the inlet and enters the chamber. Such an arrangement may further promote condensation of the vapor, nucleation of the aerosol and an increase in one or both of the amount of visible aerosol and total aerosol mass.

In some examples, a user may activate one or more heating elements by using an activation element. The activation element may be arranged at any suitable location on the shisha device. For example, the activation element may be arranged at the mouthpiece. The activation element may be, for example, in wireless communication with the control electronics and may signal control electronics to activate the heating element from standby mode to full heating. In some examples, such manual activation may only be enabled while the user puffs on the mouthpiece to prevent overheating or unnecessary heating of aerosol generating substrate in the cartridge.

A shisha device of the invention may have any suitable air management. In one example, puffing action from the user will create a suction effect causing a low pressure inside the device which will cause external air to flow through air inlet of the device, into the fresh air inlet channel, and into the receptacle of the aerosol generating element. The air may then flow through aerosol generating substrate or a cartridge containing the substrate in the receptacle to carry aerosol through the aerosol outlet of the receptacle. The low pressure caused by the user puffing may activate the nebulizer to cause the nebulizer to introduce the at least one aerosol condensation particle into the airflow path for mixing with the vapor generated from the aerosol generating substrate, which may improve nucleation as the vapor cools to form the aerosol, leading to enhanced visible aerosol. The air containing the aerosol may then flow through the conduit to the liquid inside the vessel. The aerosol will then bubble out of the liquid and into headspace in the vessel above the level of the liquid, out the headspace outlet, and through the hose and mouthpiece for delivery to the consumer. The flow of external air and the flow of the aerosol inside the shisha device may be driven by the action of puffing from the user.

Assembly of all main parts of a shisha device of the invention may assure hermetic functioning of the device. Hermetic function should assure that proper air flow management occurs. Hermetic functioning may be achieved in any suitable manner. For example, seals such as sealing rings and washers maybe used to ensure hermetic sealing.

Sealing rings and sealing washers or other sealing elements may be made of any suitable material or materials. For example, the seals may comprise one or more of graphene compounds and silicon compounds. The materials may be approved for use in humans by the U.S. Food and Drug Administration.

Main parts, such as the chamber, the conduit from the chamber, a cover housing of the receptacle, and the vessel may be made of any suitable material or materials. For example, these parts may independently be made of glass, glass-based compounds, polysulfone (PSU), polyethersulfone (PES), or polyphenylsulfone (PPSU). The parts may be formed of materials suitable for use in standard dish washing machines.

In some examples, a mouthpiece of the invention incorporates a quick coupling male/female feature to connect to a hose unit.

For purposes of example, one exemplary shisha device may comprise a vessel, an aerosol generating element and a chamber with an air accelerating inlet between the vessel and the aerosol generating element, as described above. The shisha device may further comprise a hose connecting a mouthpiece to a headspace outlet of the vessel. The aerosol generating element may comprise an electric heater and a receptacle for receiving an aerosol generating substrate or a cartridge for receiving an aerosol generating substrate. The shisha device may further comprise a power supply for supplying power to the aerosol generating element, control electronics for controlling the supply of power to the aerosol generating element and an activation element at the mouthpiece for activating the aerosol generating element. In accordance with the present invention, the shisha device comprises an airflow path extending between a fresh air inlet, the aerosol generating element, the chamber, a conduit connecting the chamber to the vessel, the vessel, the hose and the mouthpiece. Also In accordance with the present invention, the shisha device further comprises a nebulizer operably connected to a source of aerosol condensation particles, the nebulizer having a nozzle arranged to deliver aerosol condensation particles to the airflow path directly downstream of the electric heater of the aerosol generating element, upstream of the chamber with the air accelerating inlet.

For purposes of example, one method for using the exemplary shisha device as described above is provided below in chronological order. The vessel may be detached from other components of the shisha device and filled with water. One or more of natural fruit juices, botanicals, and herbal infusions may be added to the water for flavouring. The amount of liquid added should cover a portion of the conduit but should not exceed a fill level mark that may optionally exist on the vessel. The vessel may then be reassembled to the shisha device. A portion of the aerosol generating element may be removed or opened to allow the aerosol generating substrate or the cartridge to be inserted into the receptacle. The aerosol generating element may then be reassembled or closed. The device may then be turned on by a user operating the activation element. This may turn on the electric heater of the aerosol generating element to heat the aerosol generating substrate in the receptacle.

A user may puff from the mouthpiece drawing air into the shisha device at the fresh air inlet and through the airflow path. Air may be drawn through the aerosol generating element and may entrain vapor generated by the heated aerosol generating substrate. The air and vapor may be drawn out of the aerosol generating element and into the chamber through the air accelerating inlet. Puffing on the mouthpiece may activate the nebulizer to introduce aerosol condensation particles into the airflow path before the air and vapor enters the chamber. This arrangement enables the aerosol condensation particles to mix with the vapour and may promote the nucleation process. The vapor may condense in the chamber to form an aerosol and the aerosol may be drawn out of the chamber into the vessel through the conduit. The aerosol may be drawn out of the conduit into the water in the vessel and out of the water into the headspace where the aerosol is drawn out of the vessel through the headspace outlet and along the hose to the mouthpiece for inhalation by the user. The user may continue using the device until no more aerosol is visible in the chamber. The device may automatically shut off when the cartridge or substrate is depleted of usable aerosol generating substrate. In some examples, the consumer may refill the device with fresh aerosol generating substrate or a fresh cartridge after, for example, receiving an alert from the device that the consumables are depleted or nearly depleted. If refilled with fresh substrate or a fresh cartridge, the device may continue to be used. In some examples, the shisha device may be turned off at any time by a consumer by, for example, switching off the device at the activation element.

BRIEF DESCRIPTION OF THE DRAWINGS

Reference will now be made to the drawings, which depict one or more aspects described in this disclosure. However, it will be understood that other aspects not depicted in the drawings fall within the scope and spirit of this disclosure. Like numbers used in the figures refer to like components, steps and the like. However, it will be understood that the use of a number to refer to a component in a given figure is not intended to limit the component in another figure labeled with the same number. In addition, the use of different numbers to refer to components in different figures is not intended to indicate that the different numbered components cannot be the same or similar to other numbered components. The figures are presented for purposes of illustration and not limitation. Schematic drawings presented in the figures are not necessarily to scale.

DETAILED DESCRIPTION OF THE DRAWINGS

Figure 1:
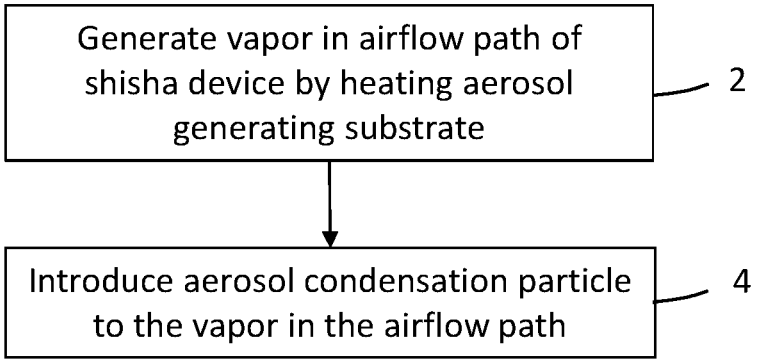
FIG. 1 is a flow diagram illustrating an embodiment of a method of the present invention.

Referring now to FIG. 1, a method for increasing one or both of visible aerosol and total aerosol mass in a shisha device comprising an aerosol generating element that heats, but does not combust, an aerosol generating substrate is shown. The method includes generating a vapor by heating the aerosol generating substrate in the shisha device (2). The method further includes introducing aerosol condensation particles to the vapor in an airflow path of the shisha device for mixing with the vapor generated by heating the substrate (4). As the vapor cools, it condenses to form an aerosol. In this embodiment, the aerosol condensation particles are introduced in the airflow path downstream of the aerosol generating substrate. The introduction of the aerosol condensation particles may improve nucleation, with may increase one or both of visible aerosol and total aerosol mass. Accordingly, a shisha device that electrically heats the aerosol generating substrate, without combusting the substrate, may produce visible aerosol and total aerosol mass similar to or greater than devices that combust the substrate.

Figure 2:
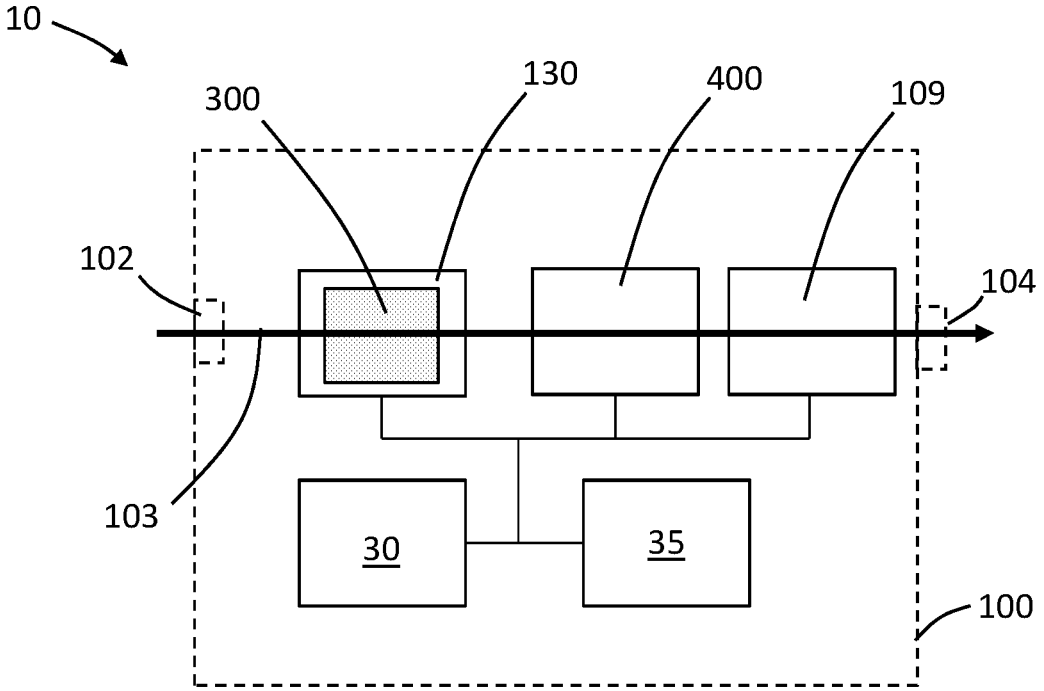
FIG. 2 is a schematic block diagram illustrating an embodiment of a shisha system of the present invention.

Referring now to FIG. 2, a system 10 comprising a shisha device 100 and an aerosol generating substrate 300 is shown. The shisha device 100 comprises an inlet 102 and an outlet 104 and an airflow path 103 (shown by the arrow) that extends from the inlet 102 to the outlet 104. The device 100 includes an aerosol generating element 130 comprising an electric heating element for heating the aerosol generating substrate 300. The substrate 300 is in the airflow path 103 of the device 100. As the substrate 300 is heated, aerosol is generated, which may be entrained in air flowing through the airflow path 103. The aerosol may be delivered to a user through the outlet 104 when the user puffs on the device 100.

The aerosol generating element 130 is operably coupled to power supply 35 and control electronics 30, which together control the temperature to which the heating element of the aerosol generating element 130 heats the substrate 300 so that the substrate 300 is sufficiently heated to produce an aerosol but is not combusted. Accordingly, combustion by-products are not delivered to the user for inhalation.

The device includes a nebulizer 400 positioned to deliver an aerosol condensation particle to the airflow path. The nebulizer 400 is downstream of the substrate 300. As air carrying vapor generated by the heated substrate 300 travels in the airflow path towards the outlet 104 the vapor may mix with the aerosol condensation particles to promote nucleation of the aerosol, increasing visible aerosol and increasing total aerosol mass.

The device 100 optionally includes a puff sensor 109 in communication with the airflow path 103. When a user puffs on the device 100 via the outlet 104 a drop in internal pressure may be detected by the puff sensor 109. The puff sensor 109 and the nebulizer 400 are operably coupled to the control electronics 30. Puff detection by the sensor 109 may cause the control electronics 30 to activate the nebulizer 400.

Figure 3:
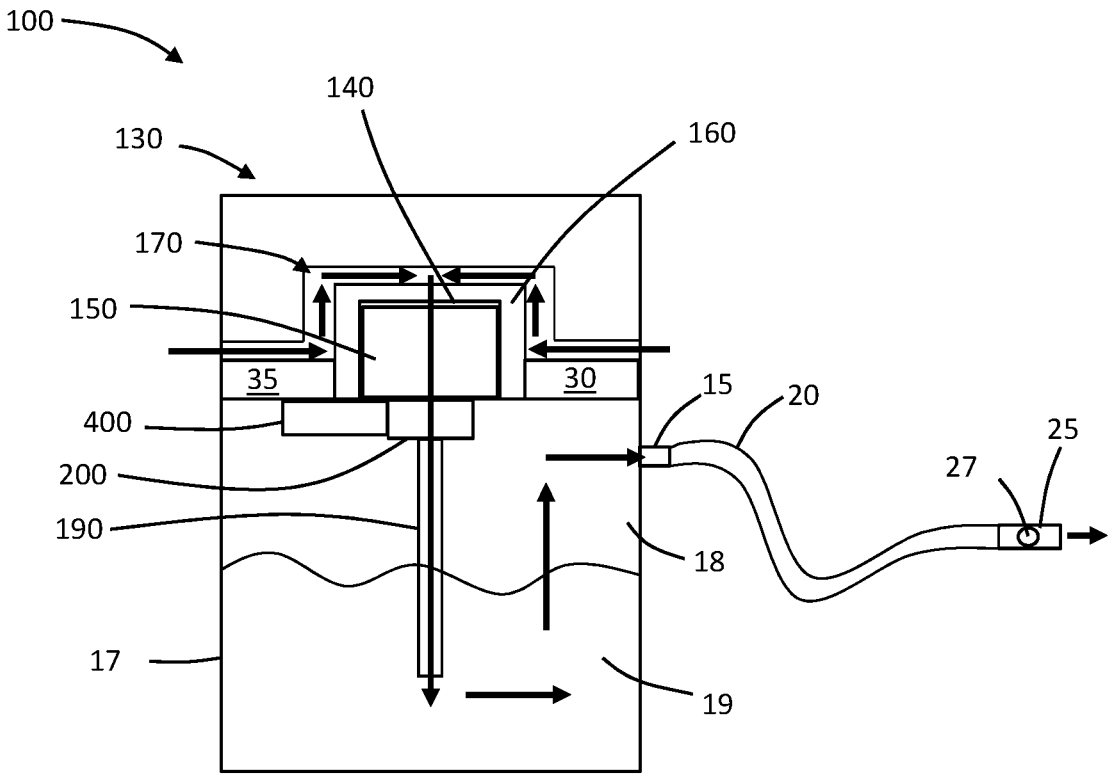
FIG. 3 is a schematic sectional diagram illustrating an embodiment of a shisha system of the present invention.

Referring now to FIG. 3, a schematic sectional drawing of an example of a shisha device 100 is shown. The device 100 includes a vessel 17 defining an interior volume configured to contain liquid 19 and defining a headspace outlet 15 above a fill level for the liquid 19. The liquid 19 preferably comprises water, which may optionally be infused with one or more colorants, one or more flavourants, or one or more colorants and one or more flavourants. For example, the water may be infused with one or both of botanical infusions or herbal infusions.

The device 100 also includes an aerosol generating element 130. The aerosol generating element 130 includes a receptacle 140 configured to receive a cartridge 150 containing an aerosol generating substrate (or receive aerosol generating substrate that is not in a cartridge). The aerosol generating element 130 also includes a heating element 160 that forms at least one surface of the receptacle 140. In the depicted embodiment, the heating element 160 defines the top and side surfaces of the receptacle 140. The aerosol generating element 130 also includes a fresh air inlet channel 170 that draws fresh air into the device 100. A portion of the fresh air inlet channel 170 is formed by the heating element 160 to heat the air before the air enters the receptacle 140. The pre-heated air then enters the cartridge 150 (or substrate that is not in a cartridge), which is also heated by heating element 160, to carry vapor generated by heated aerosol generating substrate. The air and vapor exits an outlet of the aerosol generating element 130 and enters a chamber 200 through an air accelerating inlet (not shown). As the vapor cools it condenses to form an aerosol.

A conduit 190 carries the air and aerosol from the chamber 200 into the vessel 17 below the level of the liquid 19. The air and aerosol may bubble through the liquid 19, into the headspace 18 of the vessel 17 and exit the headspace 18 via the headspace outlet 15 of the vessel 17. A hose 20 may be attached to the headspace outlet 15 to carry the aerosol to the mouth of a user. A mouthpiece 25 may be attached to, or form a part of, the hose 20.

The airflow path 103 of the device, in use, is depicted by thick arrows in FIG. 3.

The mouthpiece 25 may include an activation element 27. The activation element 27 may be a switch, button or the like, or may be a puff sensor or the like. It will be appreciated that in other embodiments the activation element 27 may be placed at any other suitable location on the device 100. The activation element 27 may be in wireless communication with the control electronics 30 to place the device 100 in condition for use or to cause control electronics 30 to activate the heating element 160; for example, by causing power supply 35 to energize the heating element 160.

The control electronics 30 and power supply 35 may be located in any suitable position of the aerosol generating element 130 other than the bottom portion of the element 130 as depicted in FIG. 3.

Figure 4:
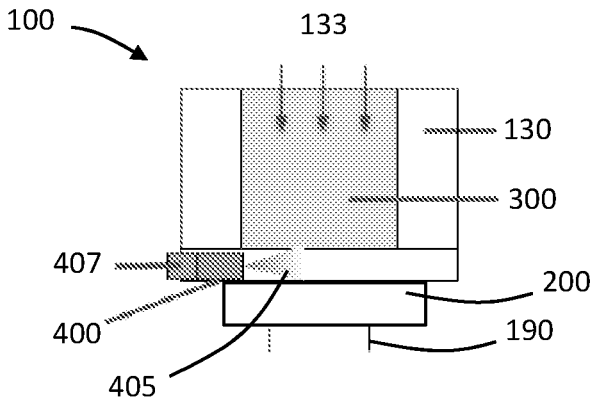
FIG. 4 is a schematic sectional diagram illustrating a portion of a shisha device of the present invention.

FIG. 4 shows a schematic sectional view of an example of a shisha device 100. Some components of the device 100 are not shown because the components are not required to understand the embodiment. The device includes an aerosol generating element 130 configured to electronically heat an aerosol generating substrate 300. The aerosol generating element 130 includes inlets 133 for fresh air to flow from outside of the aerosol generating element 130 through the aerosol generating substrate 300 and into conduit 190 for delivery to the vessel. The device 100 includes a nebulizer 400 operably coupled to a reservoir 407 containing a liquid composition. The nebulizer 400 nebulizes the liquid composition to form a plurality of aerosol condensation particles 405 that are introduced into the airflow path downstream of the substrate 300 and upstream of the conduit 190.

In this embodiment, the nebulizer 400 is positioned to introduce aerosol condensation particles into the airflow path between the heating element 160 and the chamber 200. However, it will be appreciated that in other embodiments the nebulizer 400 may be positioned to introduce the aerosol condensation particles to different locations in the airflow path. For example, the nebulizer 400 may be positioned to introduce aerosol condensation particles to the airflow path upstream of the heating element 160 or downstream of the aerosol generating element 130, such as to the chamber 200 or to the conduit 190.

Figure 5:
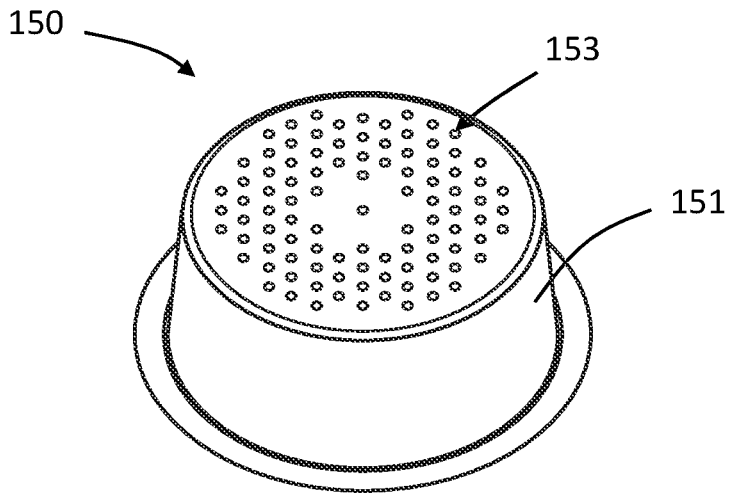
FIG. 5 is a schematic perspective diagram of a cartridge containing aerosol generating substrate for use in an embodiment of a shisha device of the present invention.

Referring now to FIG. 5, a schematic perspective view of an example of a cartridge 150 that may be used with a shisha device described herein is shown. The cartridge 150 includes a housing 151 and a plurality of apertures 153 formed in the top surface of the housing to allow air flow through the cartridge 150 and aerosol generating substrate contained in the housing. The bottom of the cartridge 150 may also contain one or more apertures to allow air flow through the cartridge 150.

Figure 6:
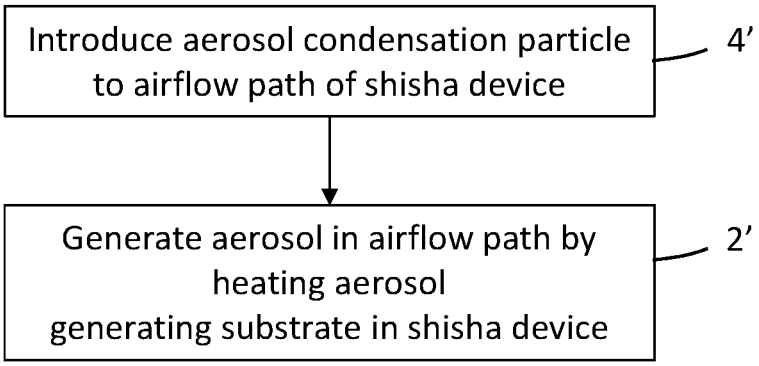
FIG. 6 is a flow diagram illustrating another embodiment of a method of the present invention.

Referring now to FIG. 6, another method for increasing one or both of visible aerosol and total aerosol mass in a shisha device comprising an aerosol generating element that heats, but does not combust, an aerosol generating substrate is shown. The method comprises similar steps to the method of FIG. 1, and like numbers used in to refer to steps of the method of FIG. 6 correspond to like numbers used to refer to like steps of the method of FIG. 1. The method includes introducing aerosol condensation particles to an airflow path of the shisha device (4'). The method further includes generating a vapor in the airflow path by heating the aerosol generating substrate in the shisha device (2'). The vapor mixes with the aerosol condensation particles in the airflow path, which promote nucleation of the vapor as the vapor cools to form an aerosol. In this embodiment, the aerosol condensation particles are introduced in the airflow path upstream of the aerosol generating substrate. The introduction of the aerosol condensation particles may improve nucleation, with may increase one or both of visible aerosol and total aerosol mass.

Figure 7:
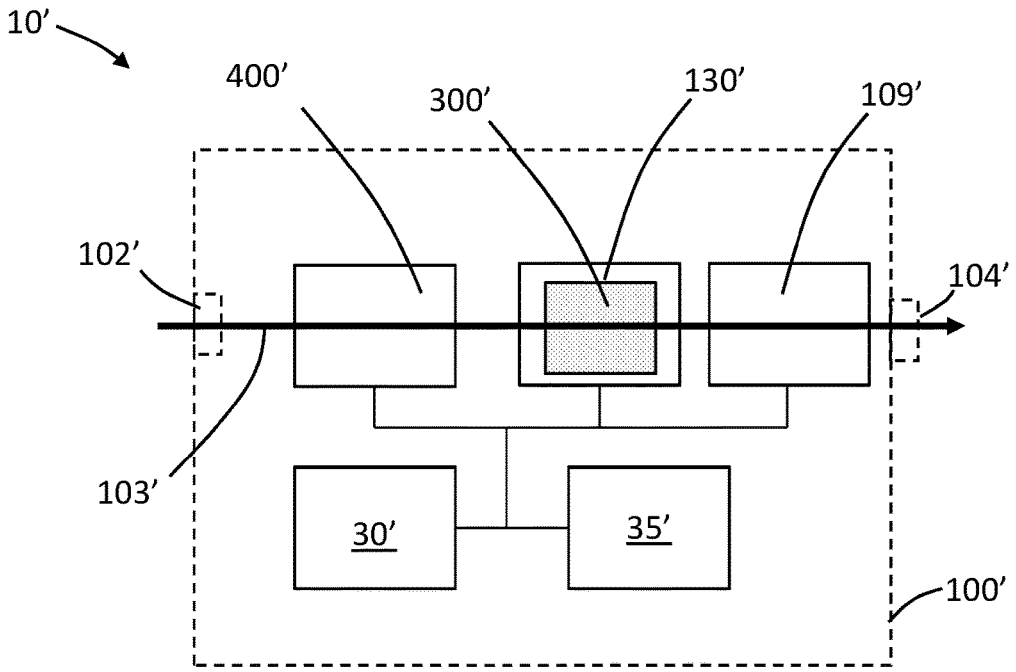
FIG. 7 is a schematic block diagram illustrating another embodiment of a shisha system of the present invention.

Referring now to FIG. 7, a system 10' comprising a shisha device 100' and an aerosol generating substrate 300' is shown. The system 10' comprises similar features to the system 10 of FIG. 2, and like numbers used to refer to features of the system of FIG. 7 correspond to like numbers used to refer to features of the system of FIG. 2. The shisha device 100' comprises an inlet 102' and an outlet 104' and an airflow path 103' (shown by the arrow) that extends from the inlet 102' to the outlet 104'. The device 100' includes an aerosol generating element 130' comprising an electric heating element for heating the aerosol generating substrate 300'. The substrate 300' is in the airflow path 103' of the device 100'. As the substrate 300' is heated, aerosol is generated, which may be entrained in air flowing through the airflow path 103'. The aerosol may be delivered to a user through the outlet 104' when the user puffs on the device 100'.

The aerosol generating element 130' is operably coupled to power supply 35' and control electronics 30', which together control the temperature to which the heating element of the aerosol generating element 130' heats the substrate 300' so that the substrate 300' is sufficiently heated to produce an aerosol but is not combusted.

The device includes a nebulizer 400' positioned to deliver an aerosol condensation particle to the airflow path. The nebulizer 400' is upstream of the substrate 300'. As air carrying aerosol condensation particles travels in the airflow path towards the outlet 104' over or through the substrate 300' the aerosol condensation particles are in the airflow path at the location at which the vapor is generated by the substrate 300'. As such, the vapor may mix with the aerosol condensation particles as soon as it is generated to promote nucleation of the aerosol, increasing visible aerosol and increasing total aerosol mass.

The device 100' optionally includes a puff sensor 109' in communication with the airflow path 103'. When a user puffs on the device 100' via the outlet 104' a drop in internal pressure may be detected by the puff sensor 109'. The puff sensor 109' and the nebulizer 400' are operably coupled to the control electronics 30'. Puff detection by the sensor 109' may cause the control electronics 30' to activate the nebulizer 400'.

The features described above in relation to one aspect of the invention may also be applicable to another aspect of the invention.

EXAMPLE

In the following non-limiting example, the ability of an aerosol condensation particle to increase the visible amount of aerosol and to increase the total aerosol mass deliverable to a user is described.

A shisha device with a nebulizer was assembled, and a shisha device without the nebulizer was assembled. The two shisha devices were essentially the same except for the presence or absence of the nebulizer.

An aerosol generating element containing a cartridge receptacle and a wound-wire heating element was coupled to a conduit that extended below a liquid level in a vessel. A cartridge filled with 10 g of commercially available Al-Fakher tobacco molasses was placed in contact with the wound-wire heating element in both devices. The wound-wire was set at a constant temperature of 230° C.

35 grams of NaCl was dissolved in 1 liter of distilled water. The resulting solution was sprayed into an aerosol phase of shisha device using the nebulizer having a pressure of 30 bar. The nebulized NaCl and water was sprayed into an aerosol path of the shisha device 2 centimeters above the cartridge.

Aerosol was collected via a headspace outlet of the vessel above the liquid level. The aerosol was collected using a total of 10 Cambridge pads whose weight was recorded before and after the smoking experience. The total duration of the experience corresponds to 105 puffs. To achieve the desired puffing experience, four Programmable Dual Syringe Pumps (PDSP) were used simultaneously to create the following puffing regime:

Puff volume: 530 mL

Puff duration: 2600 ms

Duration between puffs: 17 s

Figure 8A:
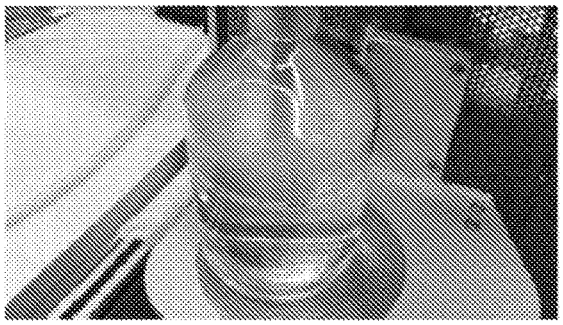
FIGS. 8A and 8B are images of shisha devices in use. The shisha device in FIG. 8A does not include a nebulizer, and the device in FIG. 8B includes a nebulizer that introduces aerosol generating particles into an airflow path for mixing with vapor generated from heating of an aerosol generating substrate.
Figure 8B:
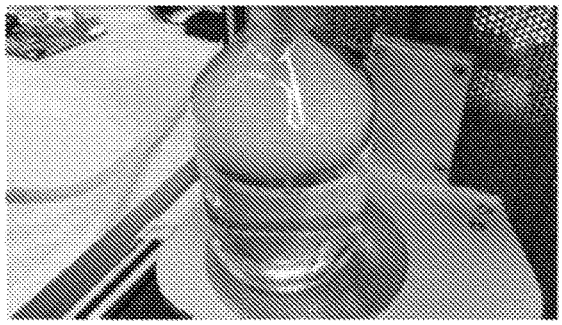

A comparison of the amount of visible aerosol present in the headspace of the vessel of a shisha device without a nebulizer and a shisha device comprising a nebulizer according to an embodiment of the present invention is shown in FIGS. 8A and 8B. FIG. 8A shows the shisha device without the nebulizer. FIG. 8B show the shisha device with the nebulizer.

The amount of visible aerosol in the headspace of the vessel of the shisha device comprising the nebulizer was drastically increased compared to the shisha device without the nebulizer, as shown in FIGS. 8A-B. In addition, the total amount of collected aerosol increased from 1202 mg (without nebulizer) to 1773 mg (with nebulizer).

The experimental setup was arranged such that only two of the ten Cambridge pads collect the generated aerosol at a given moment. Every 20 puffs, a check valve ensured that the aerosol was diverted to the correct pair of Cambridge pads. Thus, the production of aerosol could be monitored as a function of time.

Figure 9:
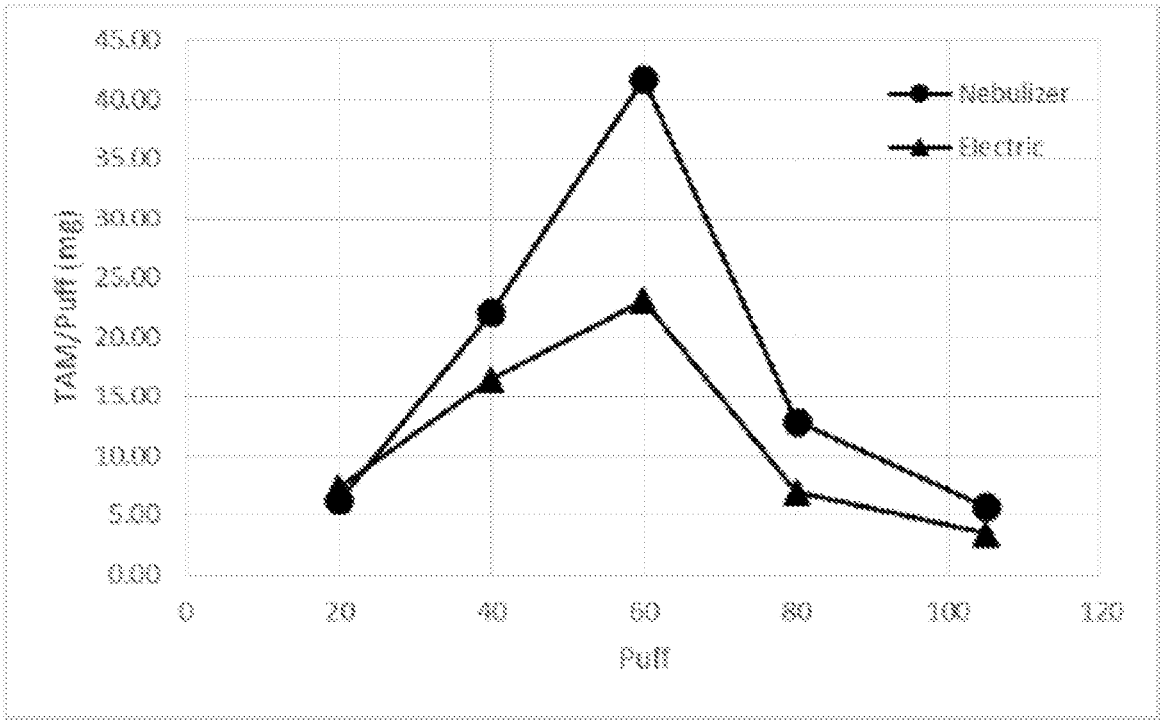
FIG. 9 is a graph showing total aerosol mass generated by a shisha device in which a nebulizer introduced aerosol generating particles in an airflow path for mixing with vapor (circles) and by a shisha device lacking a nebulizer (triangles).

In FIG. 9, the average total aerosol mass (TAM) per puff is shown for puffs 20, 40, 60, 80, and 105 for the two different configurations of shisha device. The average TAM per puff obtained by the electric shisha without the nebulizer is depicted using triangles. The TAM obtained using the same device with the addition of the nebulizer is displayed using circles.

CERTAIN DEFINITIONS

All scientific and technical terms used herein have meanings commonly used in the art unless otherwise specified. The definitions provided herein are to facilitate understanding of certain terms used frequently herein.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open-ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits under certain circumstances. However, other embodiments may also be preferred under the same or other circumstances. Furthermore, the recitation of one or more preferred embodiments does not imply that other embodiments are not useful, and is not intended to exclude other embodiments from the scope of the disclosure, including the claims.

Any direction referred to herein, such as "top," "bottom," "left," "right," "upper," "lower," and other directions or orientations are described herein for clarity and brevity are not intended to be limiting of an actual device or system. Devices and systems described herein may be used in a number of directions and orientations.

The embodiments exemplified above are not limiting. Other embodiments consistent with the embodiments described above will be apparent to those skilled in the art.

The invention claimed is:

1. A method comprising:

generating an aerosol by heating, without combusting, an aerosol generating substrate in a shisha device; and introducing at least one aerosol condensation particle to an airflow path of the shisha device to increase visible aerosol or total aerosol mass, wherein the airflow path carries the aerosol generated by the aerosol generating substrate to an outlet of the shisha device for delivery to a user.

2. A method according to claim 1, wherein the at least one aerosol condensation particle comprises a liquid droplet.

3. A method according to claim 1, wherein the at least one aerosol condensation particle comprises a solid particle.

4. A method according to claim 1, wherein the at least one aerosol condensation particle comprises at least one of sodium chloride, potassium chloride, and carbon.

5. The method of claim 1, wherein the method is carried out by the shisha device.

6. A shisha device configured to carry out the method of claim 1.

7. A shisha device comprising:

a vessel defining an interior configured to contain a volume of liquid, the vessel comprising a headspace in communication with an outlet for delivering the aerosol to the user;

an aerosol generating element in fluid connection with the vessel, wherein the aerosol generating element is configured to heat, without combusting, an aerosol generating substrate to generate an aerosol;

an airflow path arranged to carry the aerosol generated from the aerosol generating substrate to an outlet of the shisha device for delivery to a user; and an aerosol condensation particle dispenser configured to dispense at least one aerosol condensation particle into or around the airflow path to increase visible aerosol or total aerosol mass.

8. A shisha device according to claim 7, further comprising a source of the at least one aerosol condensation particle, wherein the aerosol condensation particle source is operably coupled to the aerosol condensation particle dispenser for delivering the at least one aerosol condensation particle from the source into or around the airflow path.

9. A shisha device according to claim 8, wherein the aerosol condensation particle source comprises a liquid composition comprising the at least one aerosol generating particle.

10. A shisha device according to claim 7, wherein the aerosol condensation particle dispenser is positioned to deliver the at least one aerosol condensation particle to the airflow path downstream of the aerosol generating substrate.

11. A shisha device according to claim 7, wherein the aerosol condensation particle dispenser comprises a nebulizer.

12. A shisha device according to claim 7, further comprising a puff sensor in communication with the airflow path, wherein the puff sensor is operably coupled to the aerosol condensation particle dispenser to cause the dispenser to deliver the at least one aerosol condensation particle to the airflow path in response to detection of a puff.

13. A shisha device according to claim 7, wherein the aerosol generating element comprises an electric heating element.

14. A shisha device according to claim 13, further comprising a power supply configured to supply power to the electric heating element.

15. A system comprising:

a container in which an aerosol generating substrate is disposed; and a shisha device according to claim 7, wherein the aerosol generating unit is configured to receive the container comprising the aerosol generating substrate.

16. The method of claim 1, wherein the aerosol generating substrate comprises a solid aerosol generating substrate.

17. The method of claim 1, wherein the aerosol generating substrate comprises tobacco.

18. The shisha device of claim 7, wherein the aerosol generating substrate comprises a solid aerosol generating substrate.

19. The shisha device of claim 7, wherein the aerosol generating substrate comprises tobacco.

* * * * *